US007189164B1

(12) United States Patent
Paesang et al.

(10) Patent No.: US 7,189,164 B1
(45) Date of Patent: Mar. 13, 2007

(54) PORTABLE JUVENILE SWING

(75) Inventors: Chinawut P. Paesang, Cumberland, RI (US); Jeff Pemberton, Plainville, MA (US)

(73) Assignee: Cosco Management, Inc., Wilmington, DE (US)

( * ) Notice: Subject to any disclaimer, the term of this patent is extended or adjusted under 35 U.S.C. 154(b) by 212 days.

(21) Appl. No.: 10/427,332

(22) Filed: May 1, 2003

(51) Int. Cl.
*A63G 9/00* (2006.01)

(52) U.S. Cl. ..... 472/118; 472/119; 297/16.2; 297/273

(58) Field of Classification Search ..... 472/118–125; 297/16.2, 45, 273, 281
See application file for complete search history.

(56) References Cited

U.S. PATENT DOCUMENTS

| | | | | | |
|---|---|---|---|---|---|
| 3,635,520 | A | | 1/1972 | Roher et al. | |
| 3,806,117 | A | | 4/1974 | Foster | |
| 3,838,883 | A | | 10/1974 | Machen | |
| 4,258,951 | A | * | 3/1981 | Groom | 297/16.2 |
| 4,652,047 | A | | 3/1987 | Chan | |
| 4,826,241 | A | | 5/1989 | Barras | |
| 5,413,399 | A | * | 5/1995 | Myers et al. | 297/118 |
| 5,415,455 | A | * | 5/1995 | Geldbaugh | 297/45 |
| 5,499,857 | A | | 3/1996 | Lynch, Jr. | |
| 5,533,936 | A | | 7/1996 | Julien et al. | |
| 5,893,605 | A | | 4/1999 | Chang | |
| 5,984,406 | A | | 11/1999 | Lee | |
| 6,027,409 | A | | 2/2000 | Favorito et al. | |
| 6,082,813 | A | | 7/2000 | Chen | |
| 6,179,374 | B1 | | 1/2001 | Tang | |
| 6,231,119 | B1 | | 5/2001 | Zheng | |
| 6,247,749 | B1 | | 6/2001 | Yu | |
| 6,247,750 | B1 | | 6/2001 | Tsai | |
| 6,302,479 | B1 | | 10/2001 | Zheng | |
| 6,322,138 | B1 | | 11/2001 | Tang | |
| 6,364,411 | B1 | | 4/2002 | Zheng | |
| 6,382,715 | B1 | | 5/2002 | Tang | |
| 6,382,729 | B1 | | 5/2002 | Wu | |
| 6,386,986 | B1 | | 5/2002 | Sonner et al. | |
| 6,402,230 | B1 | | 6/2002 | Tang | |
| 6,419,311 | B1 | | 7/2002 | Tang | |
| 6,454,348 | B1 | | 9/2002 | Wu | |
| 6,520,862 | B1 | | 2/2003 | Armbruster et al. | |
| 6,547,321 | B2 | * | 4/2003 | Wu | 297/16.1 |

* cited by examiner

*Primary Examiner*—Kien Nguyen
(74) *Attorney, Agent, or Firm*—Barnes & Thornburg LLP

(57) ABSTRACT

A swing apparatus comprises a swing and a support stand to which the swing is coupled for swinging movement. The support stand comprises a collapsible frame. The swing comprises a pair of hanger arms coupled to the support stand and a seat coupled to the pair of hanger arms. The seat detaches from the hangers and is at least partially collapsible.

28 Claims, 12 Drawing Sheets

PORTABLE JUVENILE SWING

BACKGROUND

The present disclosure relates to juvenile swings, and particularly, to a portable juvenile swing. More particularly, the present disclosure relates to a portable juvenile swing having a foldable frame.

A conventional juvenile swing apparatus typically has a seat suspended from a floor-supported stand by one or more hanger arms. These conventional juvenile swing assemblies usually comprise some sort of drive mechanism to move the seat and hanger arms back and forth along a swing arc in an oscillatory manner. Some juvenile swings have frames that are collapsible for storage or transport. Other known juvenile swings may be disassembled for storage or transport.

SUMMARY

According to the present disclosure, a swing apparatus comprises a swing and a support stand to which the swing is coupled for swinging movement. The swing comprises a seat and a hanger arm. The support stand comprises a foldable frame having a set of legs that are moveable between an expanded use position and a collapsed storage position.

In an illustrative embodiment, the support stand comprises first and second housings, four legs, and a linkage assembly that coordinates the folding movement of the four legs between the expanded use position and the collapsed storage position. The housings move toward one another and lower ends of the four legs are drawn towards one another when the frame is moved from the expanded use position to the collapsed storage position. One pair of the four legs serves as a first folding leg assembly having a front leg and a rear leg and the other pair of the four legs serves as a second folding leg assembly having a front leg and rear leg. The illustrative linkage assembly comprises four X-linkage pairs. Each X-linkage pair extends between a respective pair of the four legs. Two of the four X-linkage pairs extend between respective front and rear legs and comprise telescoping links.

In the illustrative embodiment, the support stand comprises four floor-engaging feet and four sliders. Each of the four floor-engaging feet is coupled to a bottom portion of a respective one of the four legs and each of the four sliders is coupled to a respective one of the four legs for movement therealong. Each of the X-linkage pairs is coupled to a respective pair of the floor-engaging feet and a respective pair of the sliders. The illustrative support stand comprises a stop and a lock coupled to one of the four legs. One of the sliders serves as a control slider that engages the stop when the legs are in the expanded use position. The lock has a locking position in which the control slider is unable to move away from the stop, thereby locking the legs in the expanded use position. The lock has a releasing position in which the control slider is able to move away from the stop to permit the legs to move from the expanded use position to the collapsed storage position.

Also in the illustrative embodiment, the swing apparatus has a pair of hanger arms and the seat is detachable from the pair hanger arms. The seat is at least partially collapsible when detached from the pair of hanger arms. The seat has a foldable scat frame and a set of panels coupled to the foldable seat frame. Each hanger arm includes a member and a coupling body coupled to the member. The seat has a pair of joints that couple portions of the foldable seat frame together for pivoting movement. The joints are attachable to the coupling bodies of the hanger arms, and when attached, the coupling bodies prevent the joints from pivoting, thereby preventing the seat frame from folding.

Additional features and advantages of the disclosure will become apparent to those skilled in the art upon consideration of the following detailed description of an illustrative embodiment exemplifying the best mode of carrying out the disclosure as presently perceived.

BRIEF DESCRIPTION OF THE DRAWINGS

The detailed description particularly refers to the accompanying figures in which.

DETAILED DESCRIPTION OF THE DRAWINGS

Figure 1:
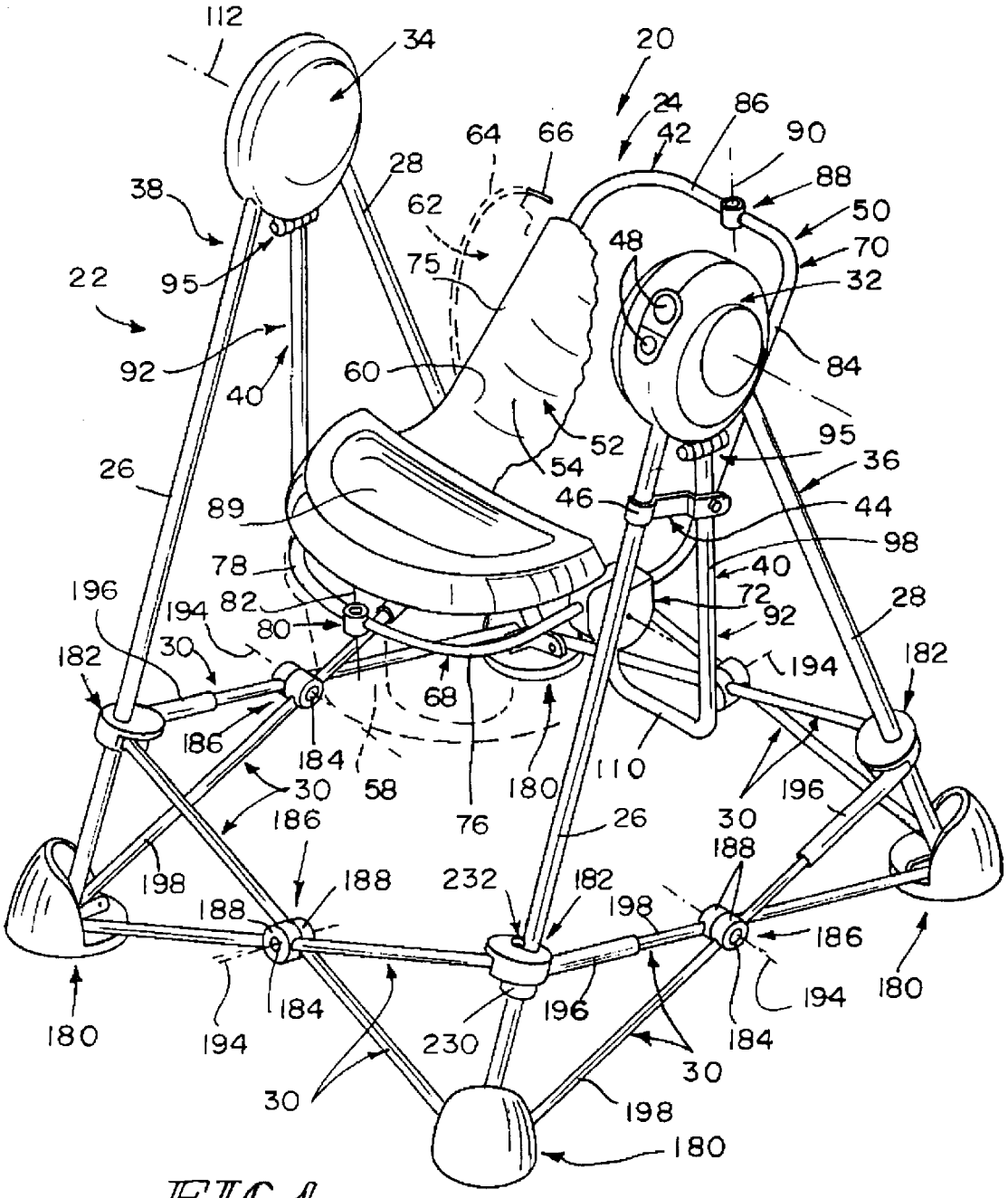
FIG. 1 is a perspective view of a juvenile swing apparatus in accordance with this disclosure showing a swing suspended with respect to a support stand and the swing comprising a seat and a pair of hanger arms.
Figure 9:
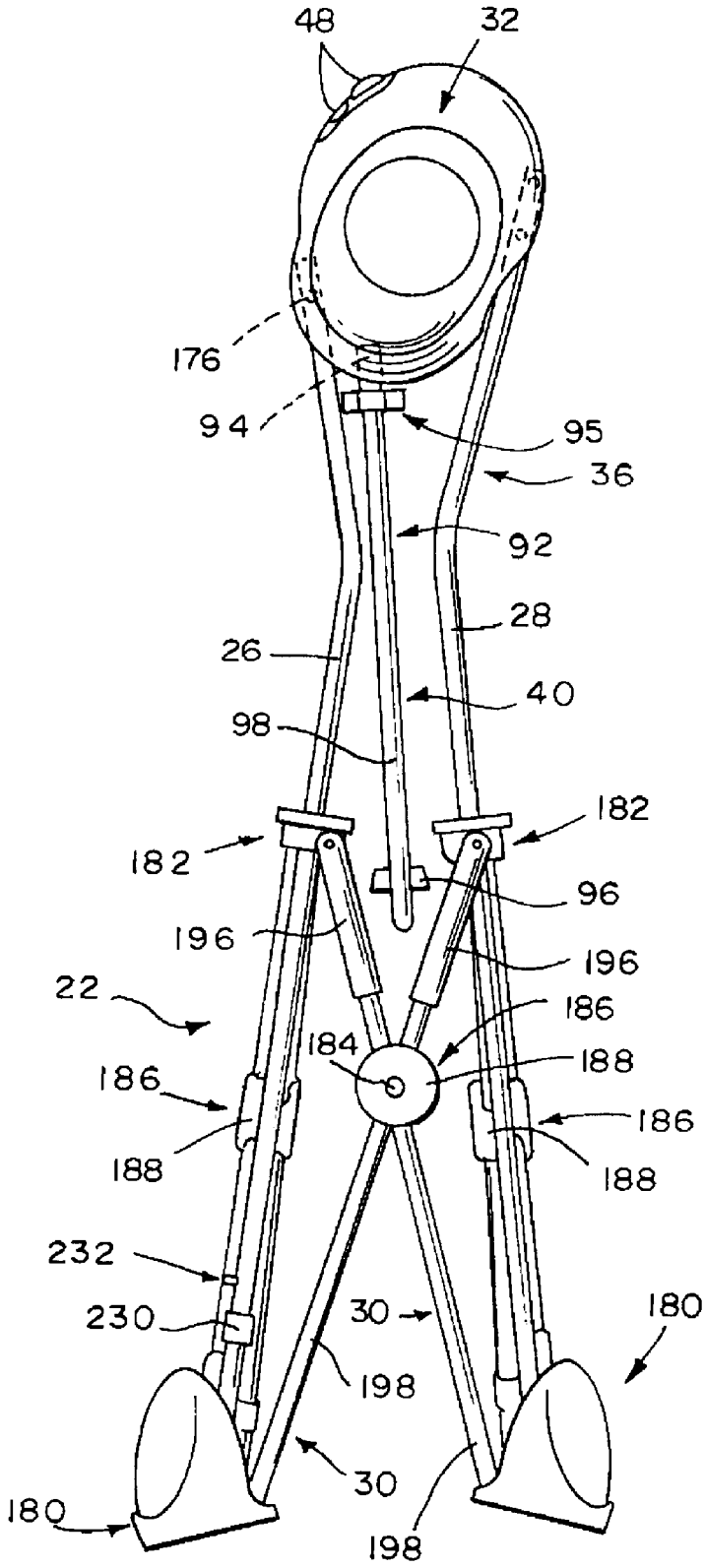
FIG. 9 is a side elevation view, similar to FIG. 2, showing the support stand of the swing apparatus in a collapsed storage position.
Figure 10:
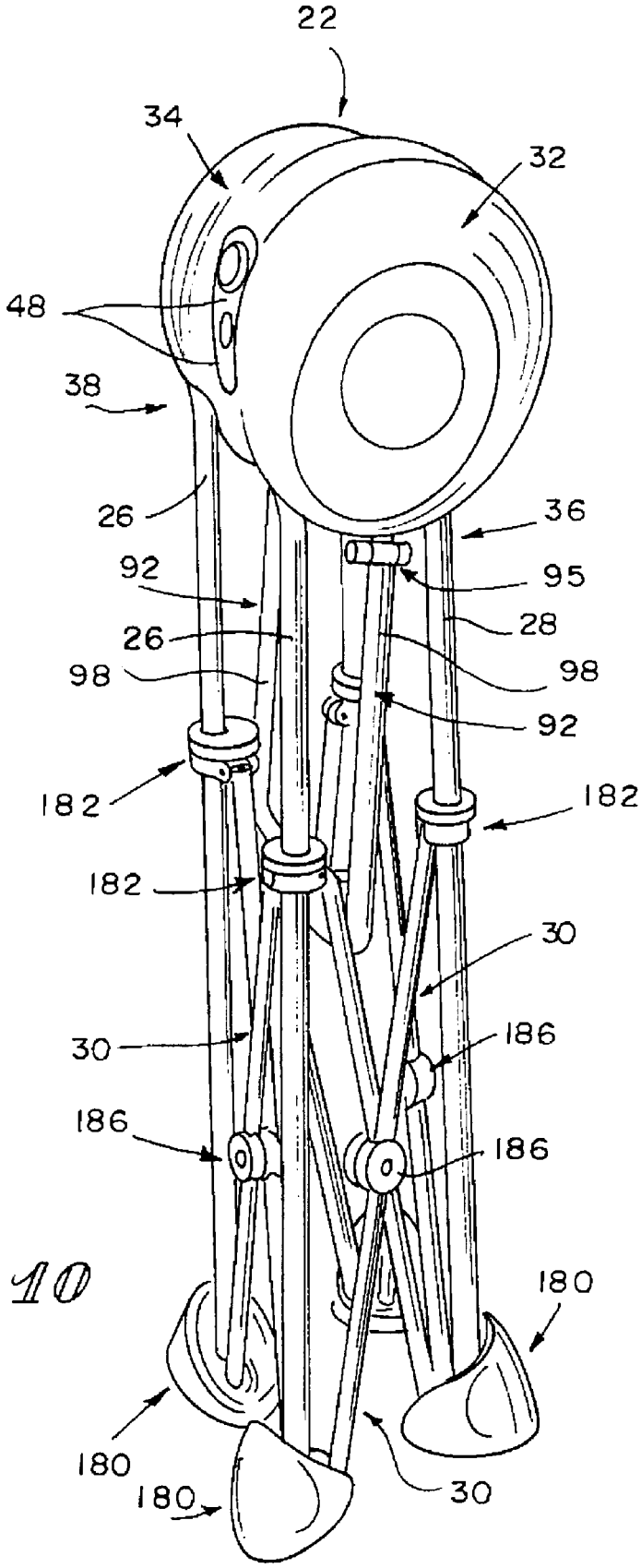
FIG. 10 is a perspective view of the support stand in the collapsed storage position.

A swing apparatus 20 comprises a support stand 22 and a swing 24 suspended for swinging movement with respect to stand 22 as shown in FIG. 1. Illustrative stand 22 comprises a plurality of frame members, including a pair of front legs 26, a pair of rear legs 28, and a set of cross links or leg supports 30. Illustrative stand 22 has a first housing 32 and a second housing 34. Swing 24 comprises a pair of hanger arms 40 and a seat 42 coupled to hanger arms 40. Hanger arms 40 extend downwardly from housings 32, 34 and are coupled thereto for swinging movement. Swing 20 is considered to be an "open top" swing because of the absence of any structure bridging between housings 32, 34 that would interfere with placement of a child into or removal of a child from seat 42. Seat 42 is detachable from hanger arms 40 and is at least partially collapsible when detached from hanger arms 40. In addition, after seat 42 is detached from hanger arms 40, frame members 26, 28, 30 of stand 22 are movable between an expanded use position, shown in FIGS. 1 and 2, and a collapsed storage position, shown in FIGS. 9–11.

When seat 42 is coupled to hanger arms 40 and stand 22 is in the expanded use position, a child may be placed in seat 42 and swing 24 may be oscillated back and forth relative to stand 22. Illustrative swing 20 has a stabilizer member 44 coupled to one of hanger arms 40 for pivoting movement between a first position, shown in FIG. 1, in which a hook portion 46 of member 44 engages one of legs 26 to prevent swinging movement of swing 24 and a second position, shown in FIG. 2, in which member 44 hangs alongside the associate hanger arm 40, for example, so that swing 24 is able to oscillate back and forth relative to stand 22. Thus, when member 44 is in the first position, swing 24 is stabilized to facilitate the placement of the child into seat 42 and the removal of the child from seat 42. In one embodiment, member 44 is made from a plastic material that is slightly flexible to permit the member 44 to flex by a slight amount during movement between the first and second positions.

Housing 26 contains a drive assembly (not shown) that is operable to move hanger arms 40 and seat 42 back and forth along a swing arc. Control buttons 48 are coupled to housing 26 and are engaged to turn the drive assembly on and off and to control the speed at which the drive assembly operates, thereby to adjust the frequency of oscillation of swing 24. In some embodiments, one of buttons 48 turns music on and off. Thus, appropriate control circuitry for controlling the music and the operation of the drive assembly is contained in housing 26 along with a power source, such as one or more batteries.

Figure 2:
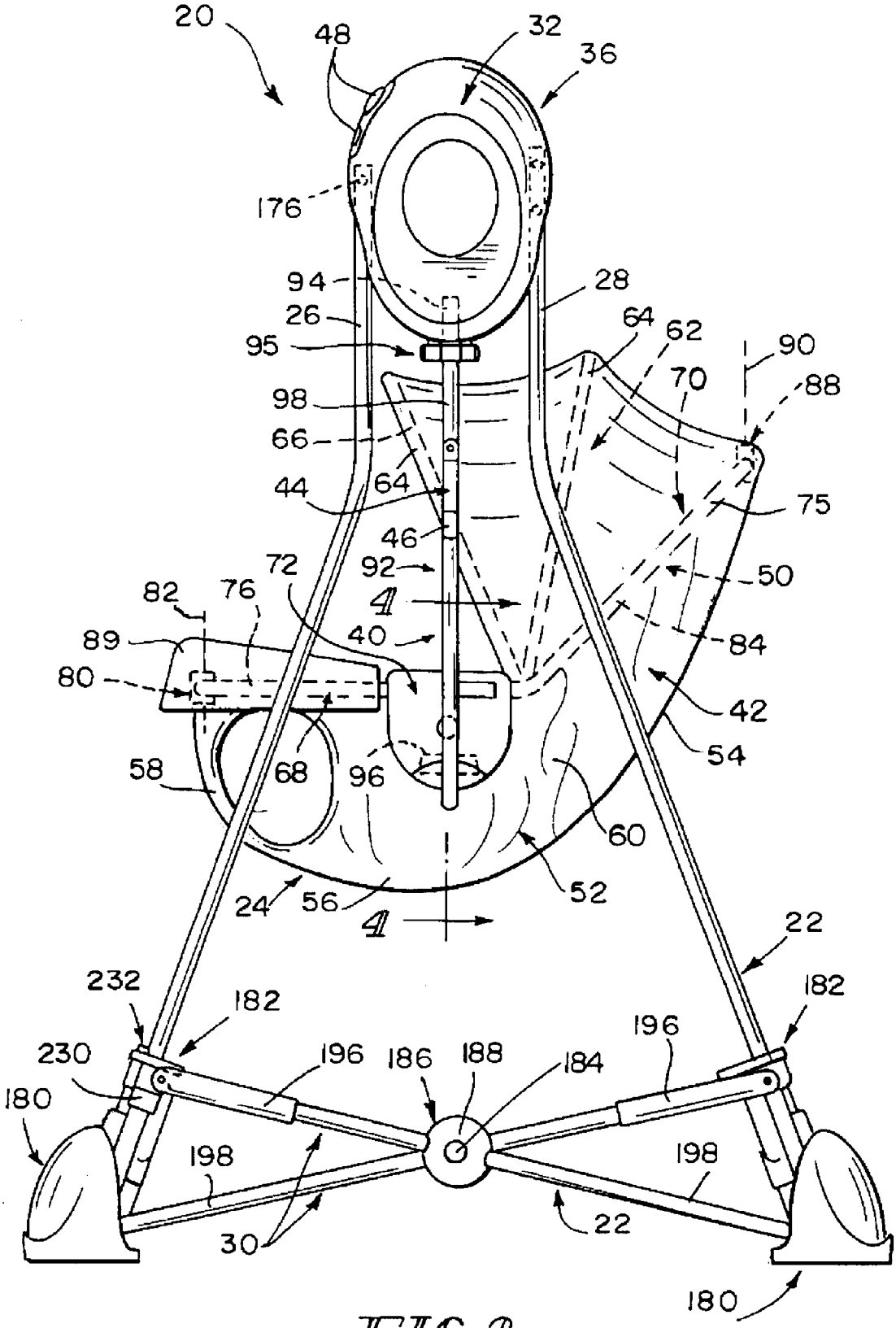
FIG. 2 is a side elevation view of the juvenile swing of FIG. 1 showing the support stand in an expanded use position, a hanger arm of the swing extending downwardly from a housing of the support stand, and a seat mounted to a lower portion of the hanger arm.

Seat 42 comprises a foldable seat frame 50 and a seat sling 52 coupled to frame 50 as shown in FIGS. 1, 2 and 6–8. Seat sling 52 has a back panel 54, a bottom panel 56, a crotch panel 58, and a pair of side panels 60. Illustrative seat sling 52 is made of fabric having suitable strength to support a child and having sufficient durability to withstand repeated cycles of folding and unfolding. Seat 42 also has a foldable canopy 62 that includes a set of elongated pockets 64 in which respective flexible rods 66 are received. Rods 66 may be made from polypropylene, for example. Rods 66 may be fanned out to support canopy 62 in an opened position overlying back panel 54 and a portion of bottom panel 56, as shown in FIG. 2. Rods 66 may be folded together to collapse canopy 62. Rods 66 form arches that extend from one side of frame 50 to the other.

Seat frame 50 has a first frame member 68, a second frame member 70, and a pair of main joints 72 coupling frame members 68, 70 together for pivoting movement about a main seat axis 74. Frame members 68, 70 are generally U-shaped and are received in pockets 75 of seat sling 52. When seat 42 is coupled to hanger arms 40, seat sling 52 hangs downwardly from frame members 68, 70, which provide the primary structural support for seat sling 52. First frame member 68 includes a first portion or strut 76, a second portion or strut 78, and a first auxiliary joint 80 coupling struts 76, 78 together for pivoting movement about a first axis 82. Similarly, second frame member 70 includes a first portion or strut 84, a second portion or strut 86, and a second auxiliary joint 88 coupling struts 84, 86 together for pivoting movement about a second axis 90. In the illustrative embodiment, pockets 75 of seat sling 52 contain padding (not shown) which surrounds or encases struts 76, 78, 84, 86 and joints 80, 88. Seat 42 also has a tray 89 which fits over frame member 68 and the associated padding and portions of sling 52.

Hanger arms 40 each comprise a main portion or member 92, a second portion or member 94, a joint 95 pivotably coupling member 94 to one end of member 92, and a coupling body 96 coupled to the other end of member 92. Hanger arms 40 also have mounts (not shown) which are situated in respective housings 32, 34 and which are pivotably coupled to housings 32, 34 for swinging movement about a horizontal main swing axis 112. Each member 94 couples to a bottom portion of a respective mount. In the illustrative embodiment, main portion 92 is somewhat J-shaped having a long segment 98, a short segment 100 parallel with segment 98, and an intermediate segment 110 interconnecting bottom ends of segments 98, 100. Coupling body 96 is coupled to the top end of segment 100 as shown in FIGS. 3–5.

Figure 3:
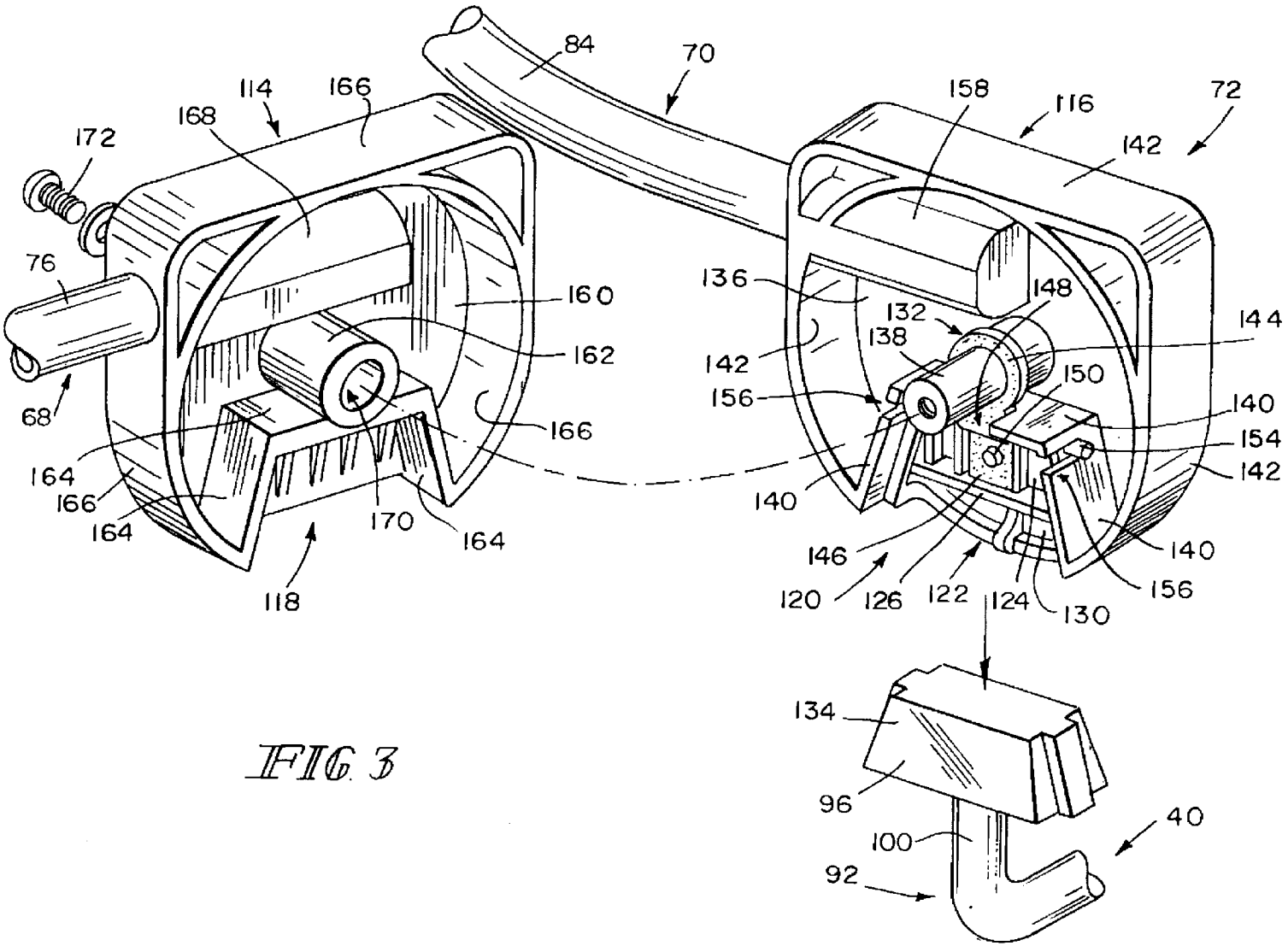
FIG. 3 is an exploded perspective view showing first and second pivot bodies of a pivotable main joint of a seat frame of the seat and showing a portion of one of the hanger arms having a coupling body to which the joint couples.
Figure 4:
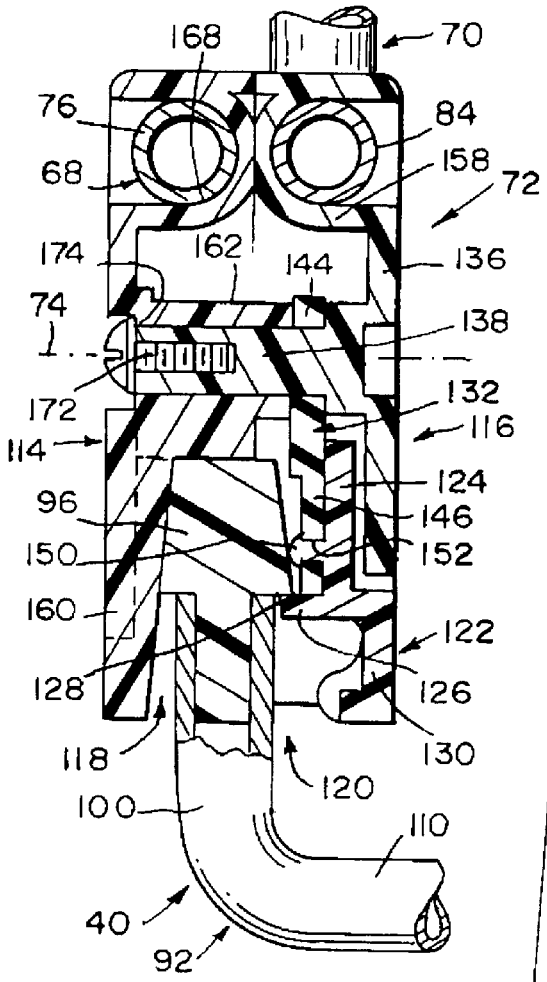
FIG. 4 is a sectional view taken along line 4—4 of FIG. 2 showing details of the coupling body received in a cavity of the joint to couple the seat to the hanger arm.
Figure 5:
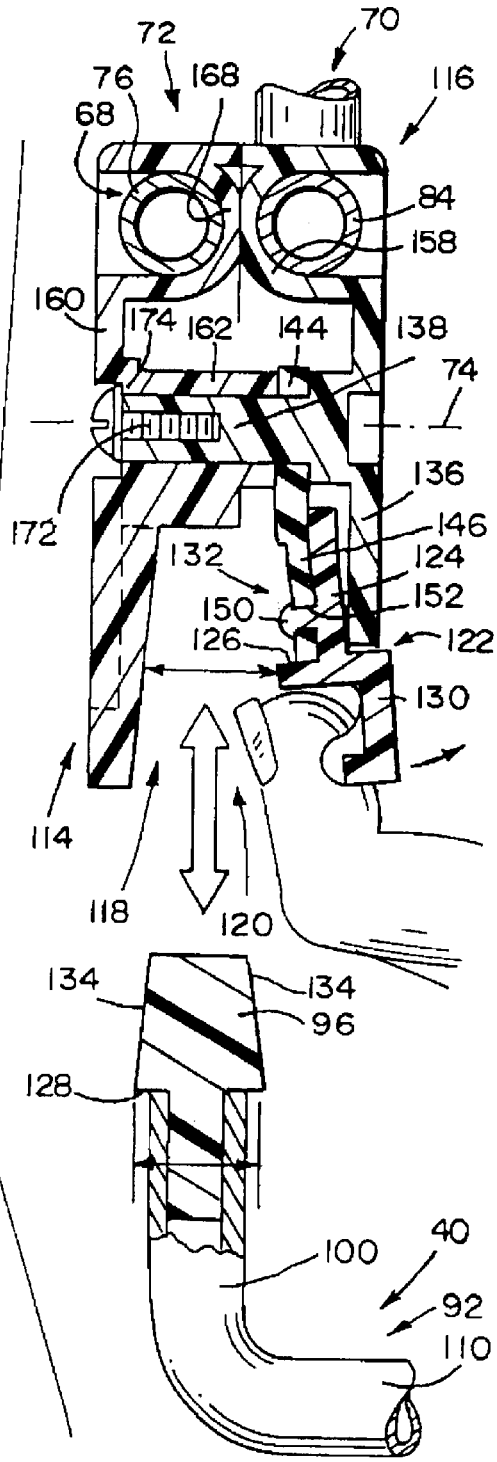
FIG. 5 is a sectional view, similar to FIG. 4, showing the coupling body of the hanger arm spaced from the joint and a user moving a lock of the joint to a releasing position.

Each main joint 72 of seat 42 comprises a first pivot body 114 and a second pivot body 116 as shown in FIGS. 3–5 First pivot body 114 is coupled to second pivot body 116 for pivoting movement about seat axis 74. Ends of struts 76, 78 that are spaced apart from joint 80 are coupled to respective pivot bodies 114 and ends of struts 84, 86 that are spaced from joint 88 are coupled to respective pivot bodies 116. Each pivot body 114 has a space 118 formed therein and each pivot body 116 has a space 120 formed therein. When pivot bodies 114, 116 are in a first position, shown in FIGS. 1, 2 and 4, spaces 118 are aligned with spaces 120 to form respective body-receiving cavities 118, 120 in associated joints 72.

Coupling bodies 96 of hanger arms 40 are configured to fit into the body-receiving cavities 118, 120 of joints 72, thereby to couple seat 42 to hanger arms 40. In some embodiments, the coupling body 96 of one of hanger arms 40 and the associated body-receiving cavity 118, 120 are shaped differently than the coupling body 96 of the other of hanger arms 40 and the associated body-receiving cavity 118, 120. In such embodiments, having differently shaped bodies 96 and cavities 118, 120, seat 42 is attachable to hanger arms 40 while facing in one direction but not in an opposite direction. If desired, coupling bodies 96 and cavities 118, 120 may be shaped similarly so that seat 42 is attachable to hanger arms 40 while facing in either direction. In one embodiment, one of coupling bodies 96, shown in FIG. 3, comprises a block forming a truncated pyramid and the other of coupling bodies (not shown) comprises a block forming half of a circular disk.

Receipt of coupling bodies 96 in cavities 118, 120 prevents pivot bodies 114 and frame member 68 of seat 42 from pivoting about axis 74 relative to pivot bodies 116 and frame member 70 of seat 42. Thus, seat 42 is not collapsible while coupled to hanger arms 40. Each joint 72 has a lock 122 that is movable between a locking position preventing separation of the joint 72 from the respective coupling body 96 and a releasing position allowing separation of the joint 72 from respective coupling body 96. In the illustrative embodiment, each lock 122 comprises a plate 124 that is pivotably coupled to a respective body 116 and that has a lip or ledge 126 which underlies a bottom surface 128 of the respective body 96 when in the locking position as shown in FIG. 4. Illustrative lock 122 also has a handle portion 130 which may be engaged by a user to move lock 122 against the bias of a leaf spring 132 to the releasing position to move lip 126 away from the bottom surface 128 of the respective body 96 as shown in FIG. 5. After both locks 122 are moved to the releasing position, the user may lift seat 42 upwardly off of coupling bodies 96 of hanger arms 40.

Illustrative coupling bodies 96 are configured with sloping side surfaces 134. When pivot bodies 114 are in the first position having spaces 118 of bodies 114 aligned with spaces 120 of pivot bodies 116 to form cavities 118, 120, seat 42 may be moved downwardly so that coupling bodies 96 enter cavities 118, 120 through respective openings provided at the bottom of bodies 114, 116 of joints 72. As seat 42 is moved downwardly in this manner, lips 126 wipe against respective surfaces 134 of each coupling body 96 thereby moving locks 122 automatically against the bias of springs 132 away from the locking positions toward the releasing positions. After lips 126 clear respective surfaces 134, springs 132 act to automatically move locks 122 back into the locking positions having lips 126 positioned beneath bottom surfaces 128 of coupling bodies 96.

The following description of one illustrative body 116 is applicable to both bodies 116 unless specifically noted otherwise. Body 116 has a vertical wall 136, a cylindrical boss 138 extending horizontally from wall 136 in a cantilevered manner, a set of interior walls 140 extending away from wall 136, and a set of outer perimeter walls 142 extending away from wall 136 as shown in FIG. 3. Walls 140, 142 and boss 138 each extend away from wall 136 in the same direction. Walls 140 outline and define space 120. Spring 132 has a ring portion 144 that is coupled to boss 168 and a downwardly hanging portion 146 that extends from portion 144 through a notch 148 formed in the wall 140 which overlies space 120 as shown in FIG. 3. Portion 146 is coupled to lock 122 by a suitable fastener 150, such as a bolt, a rivet, a headed post, or the like, which is received by an aperture 152 formed in portion 146. Lock 122 has a pair of pivot posts 154, each of which is received in a respective slot 156 formed in an associated one of the walls 140 situated alongside plate 124. Body 116 also has a socket 158 in which an end of strut 84 is received. A fastener (not shown), such as a bolt or rivet, couples strut 84 to socket 158.

The following description of one illustrative body 114 is applicable to both bodies 114 unless specifically noted otherwise. Body 114 has a vertical wall 160, a cylindrical boss 162 extending horizontally from wall 160 in a cantilevered manner, a set of interior walls 164 extending away from wall 160, and a set of outer perimeter walls 166 extending away from wall 160 as shown in FIG. 3. Walls 164, 166 and boss 162 each extend away from wall 160 in the same direction. Walls 164 outline and define space 118. Body 114 also has a socket 168 in which an end of strut 76 is received. A fastener (not shown), such as a bolt or rivet, couples strut 76 to socket 168. Boss 162 of body 114 has a bore 170 that is sized to receive boss 138 of body 116 therein for rotation about axis 74. A bolt 172 threads into boss 138 and the head of bolt 172 engages a shoulder 174 of boss 162 to prevent separation of bodies 114,116.

Figure 6:
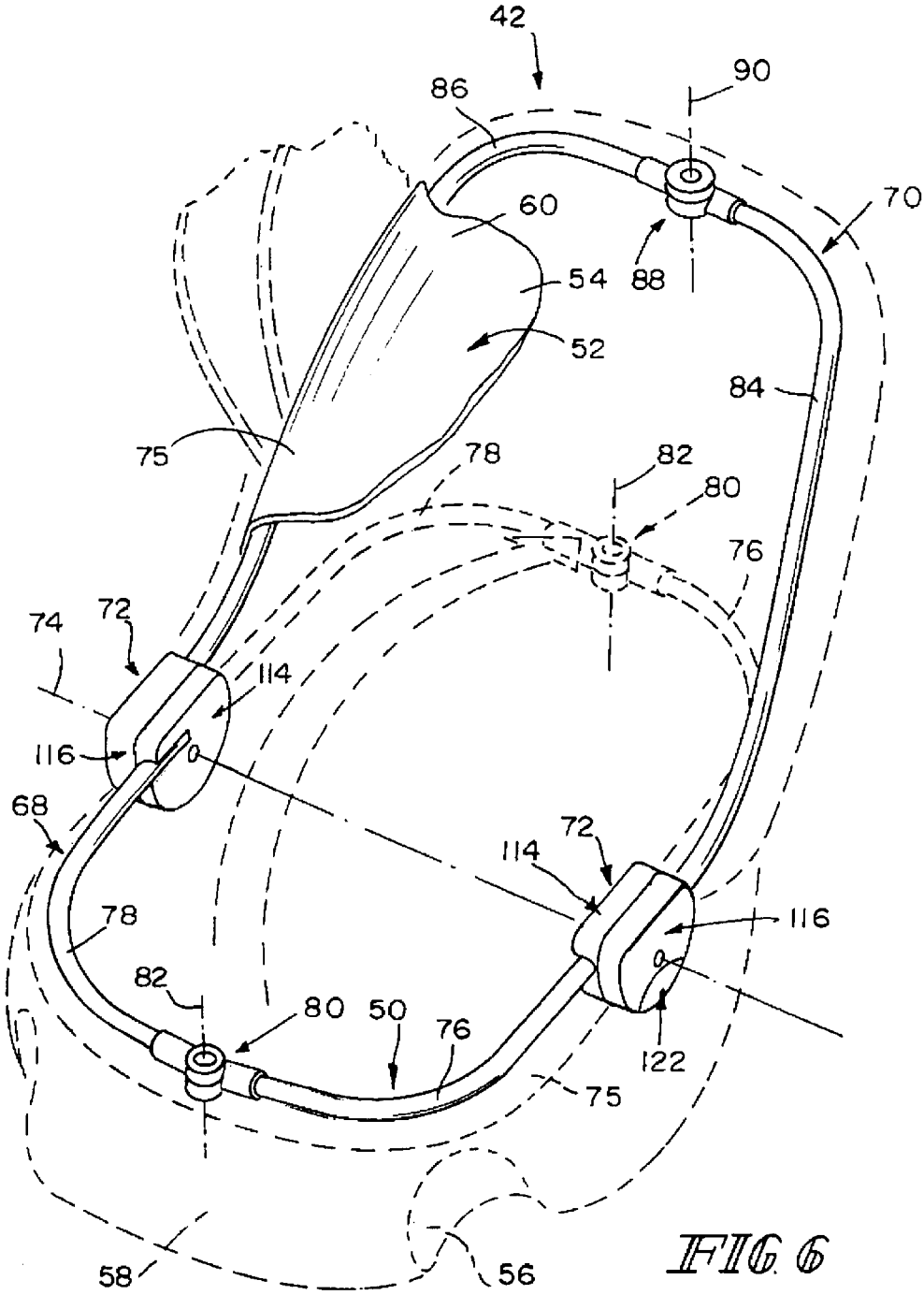
FIG. 6 is a perspective view of the seat after it has been detached from the support stand showing the seat having a foldable frame including first and second U-shaped frame members extending from the respective first and second pivot bodies.
Figure 7:
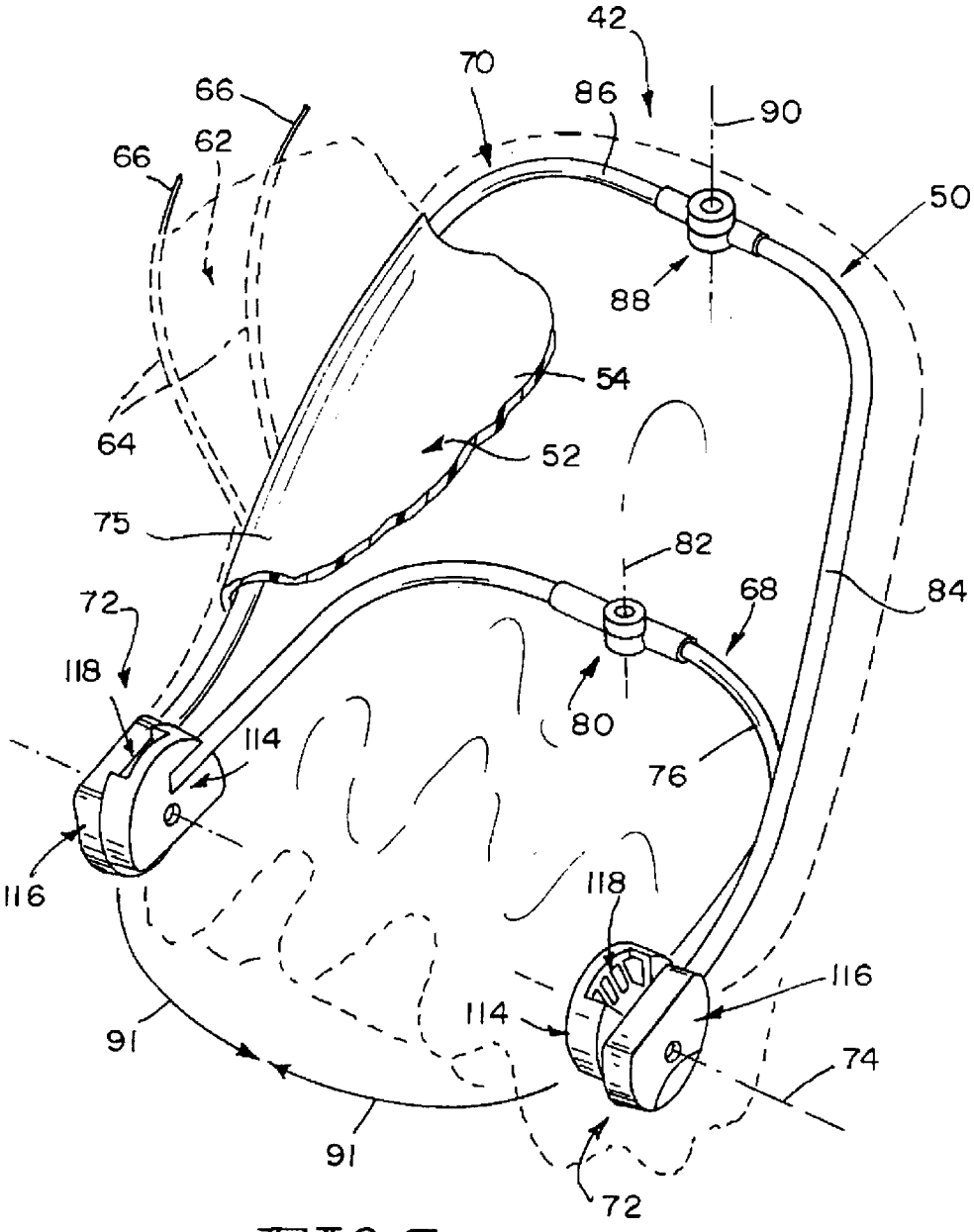
FIG. 7 is a perspective view, similar to FIG. 6, showing the first frame member pivoted relative to the second frame member through an angle of about one hundred eighty degrees to partially collapse the seat.

When seat 42 is attached to hanger arms 40, first axis 82 of joint 80 is parallel with and spaced by a large distance from second axis 90 of joint 88 as shown in FIGS. 1 and 2. After seat 42 is detached from hanger arms 40, frame member 68 of seat frame 50 and pivot bodies 114 are pivotable about axis 74 between a first position in which axes 82, 90 are spaced by the large distance, shown in FIG. 6, and a second position in which axis 92 is very close to or even coaxial with axis 90 as shown in FIGS. 6 and 7 (in phantom in FIG. 6). In the illustrative embodiment, frame member 68 and bodies 114 pivot about axis 74 through about one hundred eighty degrees when moving between the first and second positions.

Figure 8:
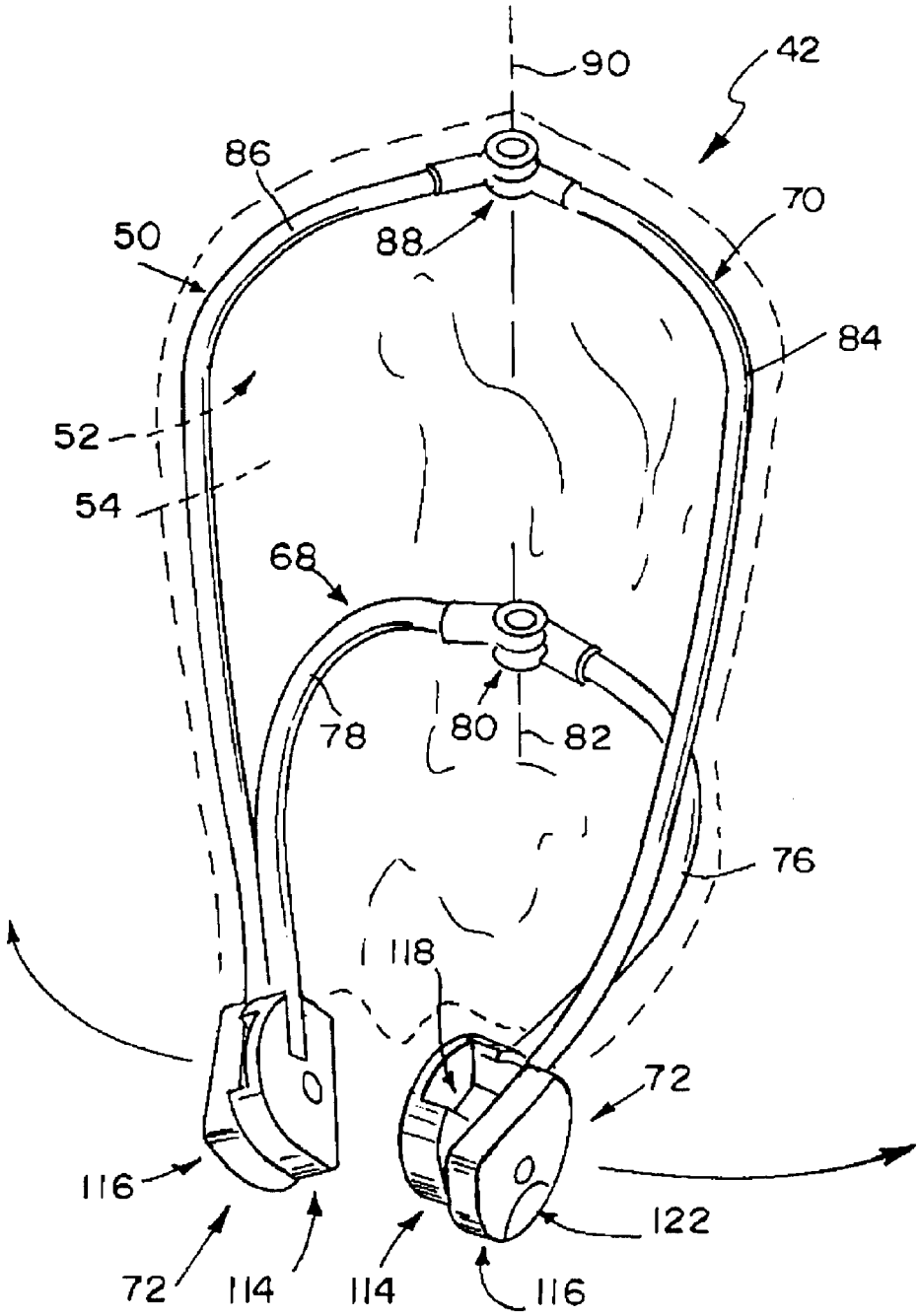
FIG. 8 is a perspective view, similar to FIG. 7, showing portions of the first and second frame members folding about respective first and second axes to move the pair of main joints toward one another to further collapse the seat.

Due to the large spacing between axes 82, 90 and the configuration of joints 72, portions 76, 78 of frame member 68 are unable to fold about axis 80 and portions 84, 86 of frame member 70 are unable to fold about axis 90 when frame member 68 and pivot bodies 114 are in the first position. However, after frame member 68 and bodies 114 are pivoted to the second position having axis 82 very close to, or coaxial with, axis 90, portions 76, 78 of frame member 68 and portions 84, 86 of frame member 70 are able to fold about axes 82, 90, respectively, to further collapse seat frame 50 as shown in FIG. 8. As seat frame 50 collapses, joints 72 move toward each other in directions 91, shown in FIG. 7, and seat sling 52 bunches or folds in a somewhat random manner. In addition, rods 66 of canopy 62 are further flexed when seat frame 50 collapses. It should be understood that, due to clearances in various components of seat frame 50 and due to a slight amount of flexibility in various components of seat frame 50, axis 82 need not be coaxial with axis 90 in order for portions 76, 78 of frame member 68 and portions 84, 86 of frame member 70 to fold about axes 82, 90, respectively, when frame member 68 and bodies 114 are in the second position.

After seat 42 is detached from hanger arms 40, support stand 22 may be moved from the expanded use position to the collapsed storage position as mentioned above. Upper end portions of front legs 26 and upper end portions of rear legs 28 are coupled to respective housings 32, 34. In the illustrative embodiment, the orientation of housings 32, 34 are fixed relative to rear legs 28 and each front leg 26 is pivotable relative to the respective housings 32, 34 about a leg pivot axis 176. Thus, a first folding leg assembly 36 is provided on a right side of swing apparatus 20 by housing 32 and the associated legs 26, 28 and a second folding leg assembly 38 is provided on the left side of swing apparatus 20 by housing 34 and the associated legs 26,28.

Stand 22 comprises four floor-engaging feet 180 as shown in FIG. 1. Two of feet 180 are pivotably coupled to the lower end portions of respective legs 26 and two of feet 180 are pivotably coupled to the lower end portions of respective rear legs 28. Stand 22 further comprises four sliders 182 that are coupled to legs 26, 28 for translational movement therealong. Leg supports 30 serve as a linkage assembly that coordinates the movement of legs 26, 28 as legs 26, 28 move between the expanded use position and the collapsed storage position. Illustrative leg supports 30 are grouped in pairs to form four X-linkage pairs which extend between associated pairs of legs 26, 28. Middle regions of leg supports 30 are coupled together for pivoting movement about respective axes 194 by respective pivot pins or bolts 184. A hub 186 is provided at the pivotable connection between leg supports 30 of each X-linkage pair. Each hub 186 comprises two hub halves 188 which are coupled to leg supports 30 by respective pins 184. Each hub half 188 pivots with an associated one of leg supports 30.

As stand 22 moves, from the expanded use position to the collapsed storage position, sliders 182 move along respective legs 26, 28 away from the associated foot 180 and toward the associated housings 32, 34. As sliders 182 move along legs 26, 28 toward housing 32, 34, leg supports 30 pivot about respective axes 194 to draw the four feet 180 toward one another and to draw housings 32, 34 toward one another. The leg supports 30 of the X-linkage assemblies at the sides of stand 22 are telescoping leg supports 30 and comprise a first portion 196 which is pivotably coupled to a respective slider 182 and a second portion 198 which is pivotably coupled to a respective foot 180.

When stand 22 is in the expanded use position, portion 198 is in an extended position relative to portion 196 and when stand 22 is in the collapsed storage position, portion 196 is in a retracted position relative to portion 196. The leg supports 30 of the X-linkage assemblies at the front and rear of stand 22 are non-telescoping leg supports 30. Thus, the leg supports 30 at the sides of stand 22 coordinate the folding movement of legs 26, 28 relative to housings 32, 34 and the leg supports 30 at the front and rear of stand 22 control the lateral distance between the housing 32, 34 and legs 26, 28 of the folding leg assemblies. As housings 32, 34 move toward one another during folding of stand 22, hanger arms 40 move toward one another. Joints 95 of hanger arms 40 permit members 92, 94 to articulate, as necessary, so that hanger arms 42 nest compactly within spaces between legs 26, 28 and leg supports 30 as shown best in FIG. 10.

Figure 12:
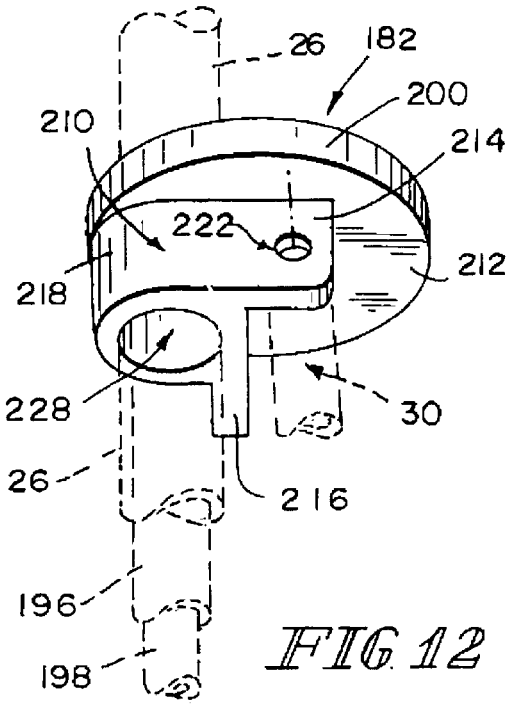
FIG. 12 is a perspective view showing one of the sliders that is coupled to a respective leg (in phantom) of a frame of the support stand for movement therealong and to which a linkage assembly (in phantom) which coordinates folding movement of the legs of the support stand is coupled.
Figure 13:
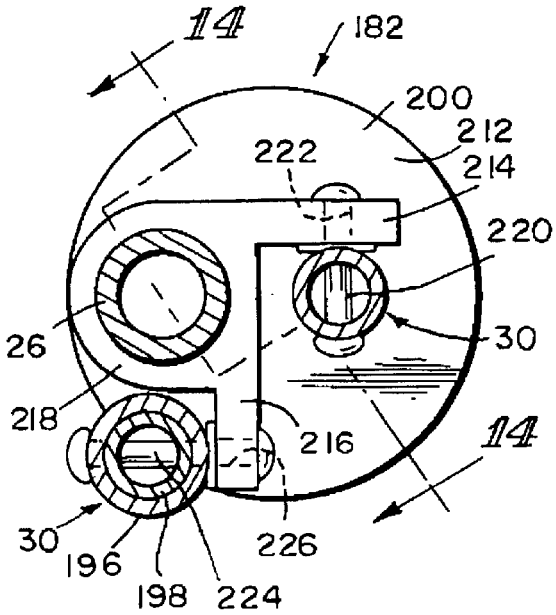
FIG. 13 is a bottom plan view of the slider of FIG. 12 showing further details of the interconnection between the slider and the associated frame members of the support stand.

The following description of one of sliders 182 is applicable to all of sliders 182 unless specifically noted otherwise. Slider 182 comprises a circular disk 200 and a flange structure 210 extending downwardly from a bottom surface 212 of disk 200 as shown in FIG. 12. Structure 210 comprises a first flange 214, a second flange 216, and a leg-receiving portion 218 formed integrally with flanges 214, 216. One of the non-telescoping leg supports 30 is coupled to flange 214 by a pivot pin 220 which extends through an aperture 222 formed in flange 214 and through associated apertures (not shown) formed in the associated leg support 30. Portion 196 of one of the telescoping leg supports 30 is coupled to flange 216 by a pivot pin 224 which extends through an aperture 226 formed in flange 216 and through associated apertures (not shown) formed in the associated portion 196. A bore 228 extends through portion 218 and through disk 200 as shown in FIG. 12. Bore 228 is sized to receive leg 26 therein with only a small amount of clearance between leg 26 and the surface defining bore 228. Thus, slider 182 is able to slide along leg 26 without binding thereon. Of course, two of sliders 182 have bores 228 that receive legs 28.

Figure 14:
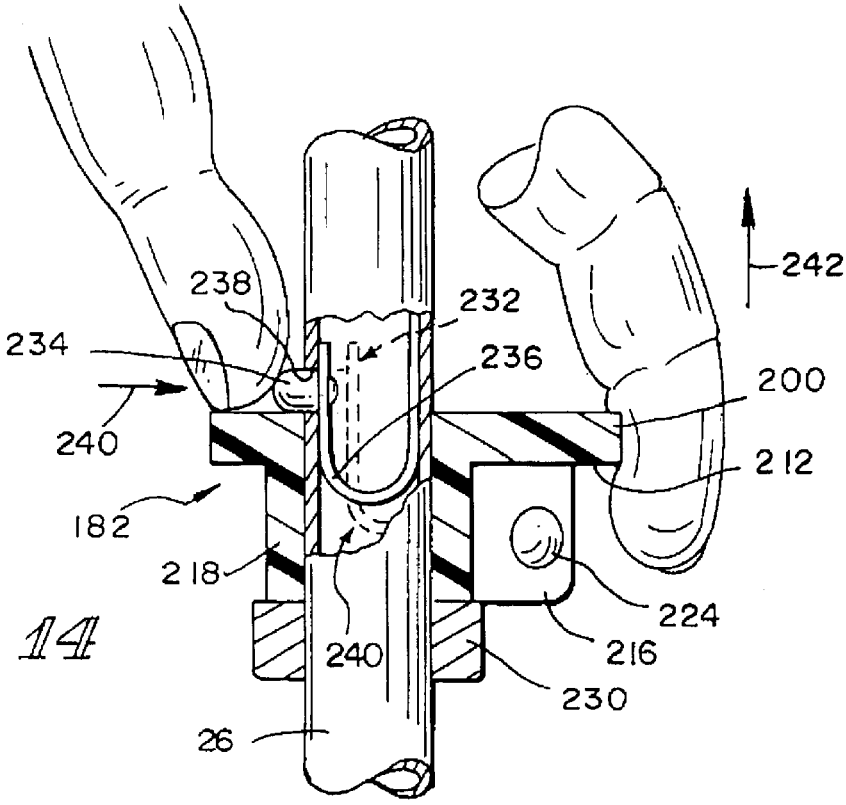
FIG. 14 is a sectional view, taken along line 14—14 of FIG. 13, showing a bottom surface of the slider engaging a stop mounted to the leg and a lock that may be moved by a user from a locking position (in solid) to a releasing position (in phantom) to permit the slider to be moved relative to the leg away from the stop.

One of sliders 182 is considered to be a control slider 182. Illustratively, the slider 182 coupled to the front leg 26 of folding leg assembly 36 on the right side of stand 22 is the control slider as shown in FIGS. 1 and 14. Stand 22 has a stop 230 and a lock 232 coupled to the same leg 26 to which the control slider 182 is coupled. In the illustrative embodiment, stop 230 comprises a collar or ring that is mounted on leg 26. A bottom surface 234 of slider 182 engages stop 230 to limit the downward movement of slider 182 on leg 26 toward the associated foot 180. Engagement between the control slider 182 and stop 230 occurs when stand 22 is in the expanded use position and prevents the X-linkages from moving so as to spread legs 26, 28 apart any further. Any type of structure or element that limits the downward movement of slider 182, such as a pin, a lug, a flange, a block, a shoulder formed in leg 26, or the like, may serve as a stop in accordance with this disclosure.

Illustrative lock 232 comprises a pin or button 234 and a U-shaped spring 236 that is situated in an interior region 240 of leg 26 and that biases button 234 through an aperture 238 formed in leg 26 toward an outward locking position as shown in FIG. 14. When stand 22 is in the expanded use position and button 234 is in the locking position, the control slider 182 is trapped between button 234 and stop 230 to lock stand 22 in the expanded use position. A user may press button 234 inwardly in direction 242, shown in FIG. 14, against the bias of spring 236 to move button 234 from the locking position to a releasing position, shown in FIG. 14 (in phantom). After button 234 is moved to the releasing position by the user, the user may pull upwardly on the control slider 182 to move slider 182 away from the associated foot 180 in direction 242. Movement of the control slider 182 in direction 242 causes all of leg supports 30 of the X-linkage pairs to fold about respective axes 194 thereby moving stand 22 from the expanded use position to the collapsed storage position.

Figure 15:
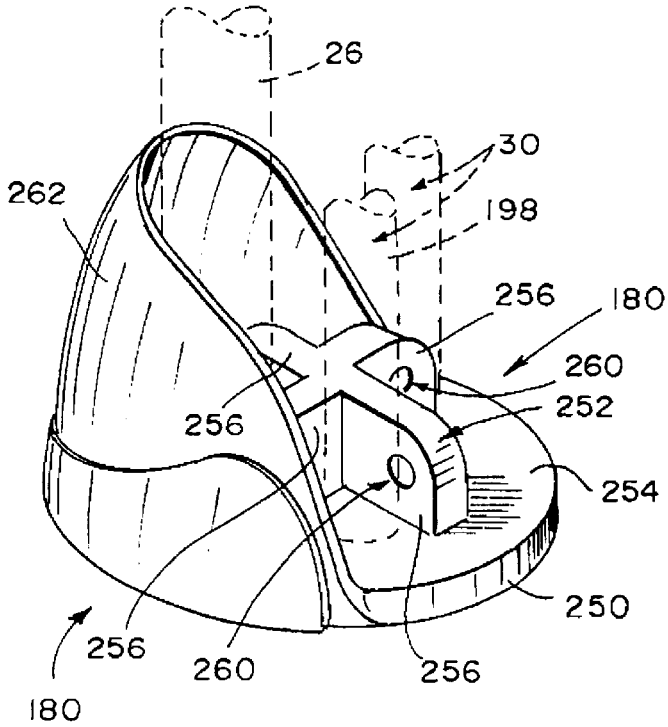
FIG. 15 is a perspective view showing one of the floor-engaging feet of the support stand and showing the associated frame members (in phantom) of the support stand coupled to flanges of the floor-engaging foot.
Figure 16:
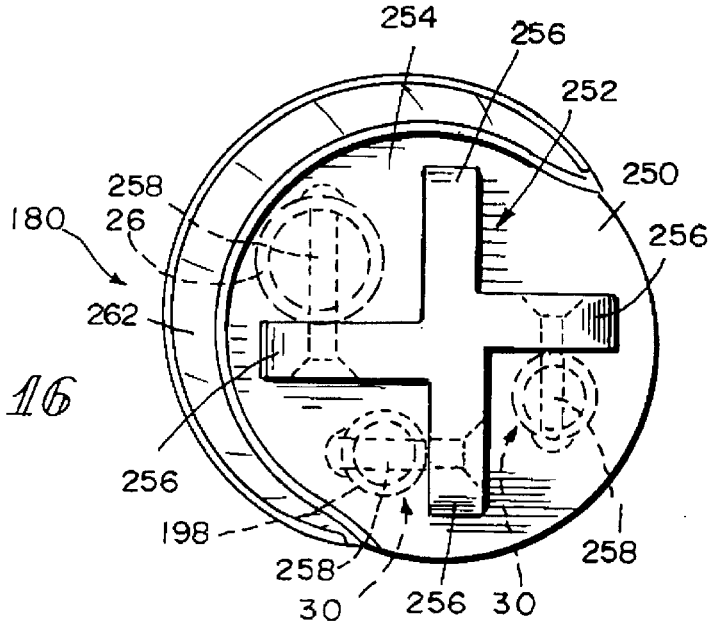
FIG. 16 is a top plan view of the floor-engaging foot of FIG. 15 showing further details of the interconnection between the floor-engaging foot and the associated frame members of the support stand.

The following description of one of floor-engaging feet 180 is applicable to all of feet 180 unless specifically noted otherwise. Foot 180 comprises a circular disk 250 and a somewhat X-shaped flange structure 252 extending upwardly from a top surface 254 of disk 250 as shown in FIG. 15. Structure 252 comprises four flanges 256 formed integrally with each other and with disk 250. A set of three pivot pins 258 are provided for pivotably coupling an associated leg 26 and an associated pair of leg supports 30, including one non-telescoping leg support 30 and portion 198 of one telescoping leg support 30, to respective flanges 256 as shown in FIG. 16 (in phantom). Each flange 256 has an aperture 260 through which an associated pin 258 extends. One of flanges 256 of foot 180 is unused. Foot 180 also has a curved shield 262 which extends upwardly from a portion of the periphery of disk 250.

Figure 11:
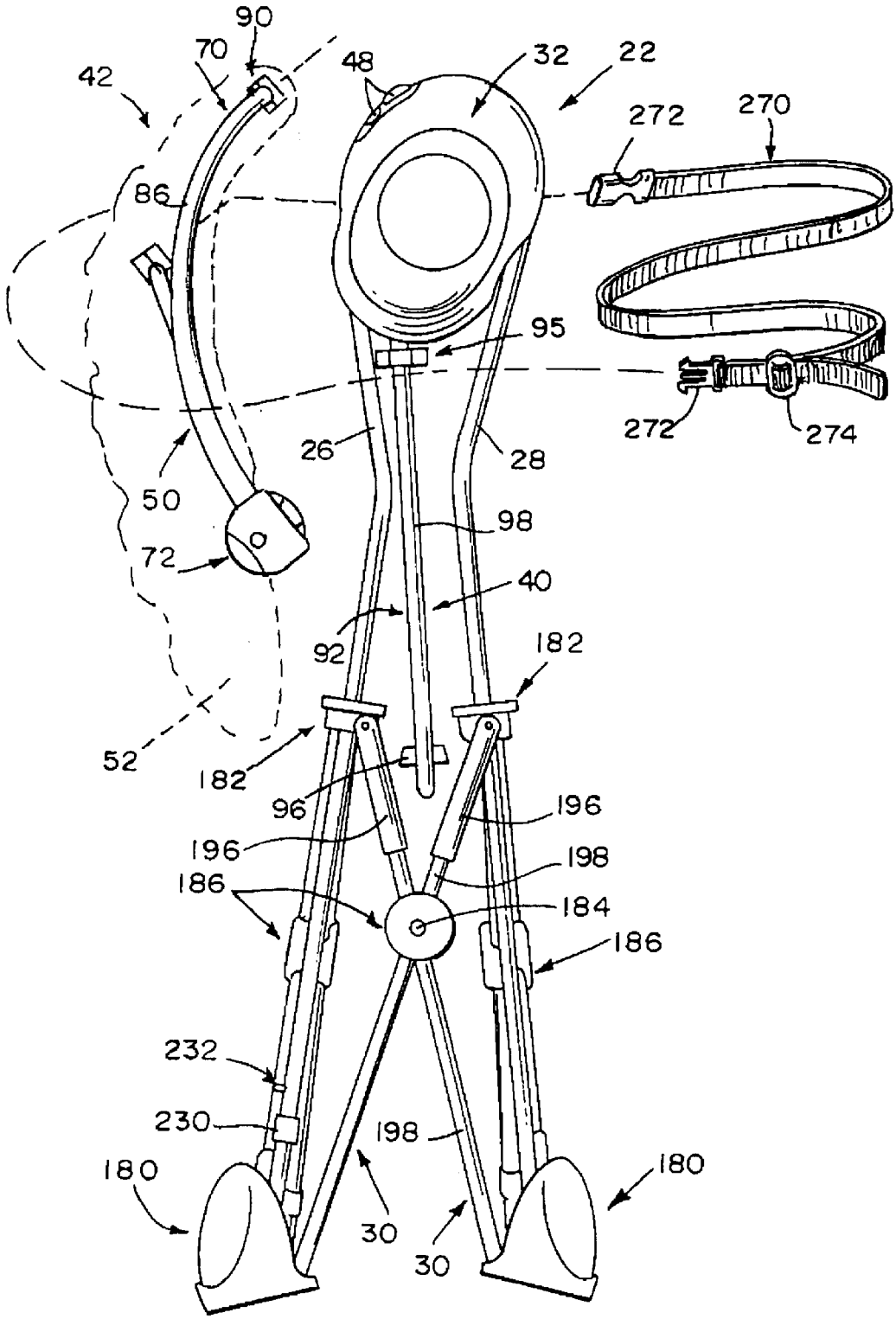
FIG. 11 is a side elevation view similar to FIG. 9, showing the collapsed seat positioned adjacent an upper end of the collapsed support stand and a strap that may be wrapped around the seat and support stand to fasten the seat and support stand together for transport or storage.

After seat 42 is removed from hanger arms 40 and collapsed and after stand 22 is moved to the collapsed storage position, the collapsed seat 42 may be coupled to the collapsed stand 22 with a strap 270 as suggested in FIG. 11. Illustratively, seat 42 is secured to housings 32, 34 and the upper portions of legs 26, 28 with strap 270. A pair of couplers 272 that snap together is provided on strap 270. In addition, an adjuster 274 for changing the effective length of strap 270 between couplers 272 is also provided on strap 270. After seat 42 and stand 22 are coupled together by strap 270, swing 20 may be transported or stored in the collapsed configuration. In alternative embodiments, swing 20 may be placed in a bag for storage or transport. Such a bag may have a first pouch configured to carry stand 22 in the collapsed storage position and a second pouch configured to carry seat 42 in the collapsed configuration.

Although the disclosure has been described in detail with reference to certain illustrative embodiments, variations and modifications exist within the scope and spirit of the disclosure as described and as defined in the following claims.

What is claimed is:

1. A swing apparatus comprising a pair of hanger arms, a seat that is attachable to and detachable from the pair of hanger arms, a support stand having a plurality of frame members that are movable between an expanded use position and a collapsed storage position, the seat being attached to the pair of hanger arms when the frame members are in the expanded use position to swing with the pair of hanger arms relative to the support stand, the seat being detached from the pair of hanger arms when the frame members are moved from the expanded use position to the collapsed storage position, each of the pair of housings and each of the associated hanger arms moving toward the other of the pair of housings and the other of the associated hanger arms during movement of the frame members from the expanded use position to the collapsed storage position.

2. The swing apparatus of claim 1, wherein the frame members comprise four legs and a linkage assembly that coordinates movement of the four legs, the linkage assembly being configured so that, as two of the four legs are pivoted relative to the pair of housings, lower ends of the four legs are drawn towards one another.

3. The swing apparatus of claim 2, wherein the linkage assembly comprises four X-linkage pairs and each X-linkage pair extends between a respective pair of the four legs.

4. The swing apparatus of claim 3, wherein two of the X-linkage pairs each comprise a pair of telescoping links that are pivotably coupled together.

5. The swing apparatus of claim 3, wherein the support stand comprises four floor-engaging feet and four sliders, each of the four floor-engaging feet is coupled to a bottom portion of a respective one of the four legs, each of the four sliders is coupled to a respective one of the four legs for movement therealong, and each of the X-linkage pairs is coupled to a respective pair of the floor-engaging feet and a respective pair of the sliders.

6. The swing apparatus 2, wherein the support stand comprises four floor-engaging feet and four sliders, each of the four floor-engaging feet is coupled to a bottom portion of a respective one of the four legs, each of the four sliders is coupled to a respective one of the four legs for movement therealong, and the linkage assembly is pivotably coupled to the four floor-engaging feet and to the four sliders.

7. The swing apparatus of claim 6, wherein the support stand comprises a stop and a lock coupled to one of the four legs, one of the sliders serves as a control slider that engages the stop when the frame members are in the expanded use position, the lock has a locking position in which the control slider is unable to move away from the stop thereby locking the frame members in the expanded use position, and the lock having a releasing position in which the control slider is able to move away from the stop to permit the frame members to move from the expanded use position to the collapsed storage position.

8. The swing apparatus of claim 1, wherein the seat is configured to at least partially collapse when detached from the pair of hanger arms.

9. The swing apparatus of claim 8, wherein the seat comprises a pair of first pivot bodies, a pair of second pivot bodies coupled to the first pivot bodies for pivoting movement about a seat axis, a first seat frame member coupled to the pair of first pivot bodies, a second seat frame member coupled to the pair of second pivot bodies, and a set of seat panels coupled to the first and second seat frame members, the first seat frame member includes portions that fold about a first frame axis, the second seat frame member includes portions that fold about a second frame axis, and the second seat frame member is pivotable with the second pair of pivot bodies between a first position in which the second frame axis is spaced from the first frame axis by a sufficient distance to prevent folding of the portions of the first and second seat frame members and a second position in which the second frame axis is close enough to the first frame axis to allow simultaneous folding of the portions of the first and second seat frame members.

10. The swing apparatus of claim 9, wherein the pair of first pivot bodies each have a first space formed therein, the pair of second pivot bodies each have a second space formed therein, each of the pair of hanger arms comprises a member and a coupling body coupled to the member, and when the second seat frame member and pair of second pivot bodies are in the first position, the second spaces are aligned with the first spaces to define a pair of enlarged spaces that are sized to receive the coupling bodies of the hanger arms therein.

11. A swing apparatus comprising a swing, and a support stand to which the swing is coupled for swinging movement, the support stand having a front leg, a rear leg, and a pair of telescoping leg supports extending between the front and rear legs, the front and rear legs being movable between an expanded use position and a collapsed storage position, each of the pair of telescoping leg supports being in an extended position when the front and rear legs are in the expanded use position, each of the pair of telescoping leg supports being in a retracted position when the front and rear legs are in the collapsed storage position.

12. The swing apparatus of claim 11, wherein the pair of telescoping leg supports are coupled together to form an X-linkage arrangement.

13. The swing apparatus of claim 12, wherein the support stand has a front floor-engaging foot coupled to a bottom portion of the front leg, a front slider coupled to the front leg for movement therealong, a rear floor-engaging foot coupled to a bottom portion of the rear leg, and a rear slider coupled to the rear leg for movement therealong, wherein one of the pair of telescoping leg supports is pivotably coupled to the front floor-engaging foot and to the rear slider, and the other of the pair of telescoping leg supports is pivotably coupled to the rear floor-engaging foot and to the front slider.

14. The swing apparatus of claim 13, wherein the support stand comprises a stop and a lock coupled to one of the front and rear legs, one of the front and rear sliders serves as a control slider that is trapped between the stop and the lock when the front and rear legs are in the expanded use position and the lock is in a locking position, and the lock is movable to a releasing position to allow the control slider to move away from the stop thereby allowing the telescoping leg supports to move from the extended position to the retracted position resulting in movement of the front and rear legs from the expanded use position to the collapsed storage position.

15. The swing apparatus of claim 11, wherein the swing comprises a hanger arm coupled to the support stand and a seat that is attachable to and detachable from the hanger arm, the seat having a foldable seat frame and a set of panels coupled to the foldable seat frame, the hanger arm having a member and a coupling body coupled to the member, the seat having a cavity in which the coupling body is received to couple the seat to the hanger arm, and receipt of the coupling body in the cavity preventing the foldable seat frame from folding.

16. The swing apparatus of claim 15, wherein the foldable seat frame comprises a first pivot body, a second pivot body coupled to the first pivot body for pivoting movement about a scat axis between a first position and a second position, the first pivot body has a first space formed therein, the second pivot body has a second space formed therein, the second space being aligned with the first space to form the cavity when the second pivot body is in the first position, and the second space being misaligned with the first space when the second pivot body is in the second position.

17. A swing apparatus comprising a swing, and a support stand to which the swing is coupled for swinging movement, the support stand comprising a pair of folding leg assemblies, one of the folding leg assemblies being situated adjacent a right side of the swing and the other of the folding leg assemblies being situated adjacent a left side of the swing, each of the folding leg assemblies having a front leg and a rear leg, and the support stand comprising first means for coordinating folding movement of the front and rear legs of the pair of leg assemblies and second means for changing a lateral distance between the pair of folding leg assemblies as the front and rear legs are folded.

18. The swing apparatus of claim 17, wherein the first means comprises two pairs of telescoping leg supports and the second means comprises two pairs of non-telescoping leg supports, each of the two pairs of telescoping leg supports extending between the front and rear legs of respective folding leg assemblies, one of the pair of non-telescoping leg supports extending between the front legs of the pair of folding leg assemblies, and the other of the pair of non-telescoping leg supports extending between the rear legs of the pair of folding leg assemblies.

19. The swing apparatus of claim 17, wherein the support stand has four floor-engaging feet and four sliders, each floor-engaging foot is coupled to a bottom portion of a respective one of the pairs of front and rear legs, each slider is coupled to a respective one of the pairs of front and rear legs for movement therealong, and the first and second means are coupled to each floor-engaging foot and to each slider.

20. The swing apparatus of claim 19, wherein the support stand comprises a stop and a lock coupled to one of the front and rear legs of one of the folding leg assemblies, one of the sliders serves as a control slider that is trapped between the stop and the lock to prevent folding movement of the pair of folding leg assemblies, and the lock is movable to a releasing position to allow the control slider to move away from the stop thereby allowing folding movement of the pair of folding leg assemblies.

21. The swing apparatus of claim 17, wherein the swing comprises a hanger arm coupled to the support stand and a seat that is attachable to and detachable from the hanger arm, the seat having a foldable seat frame and a set of panels coupled to the foldable seat frame, the hanger arm having a member and a coupling body coupled to the member, the seat having a cavity in which the coupling body is received to couple the seat to the hanger arm, and receipt of the coupling body in the cavity preventing the foldable seat frame from folding.

22. The swing apparatus of claim 21, wherein the foldable seat frame comprises a first pivot body, a second pivot body coupled to the first pivot body for pivoting movement about a seat axis between a first position and a second position, the first pivot body has a first space formed therein, the second pivot body has a second space formed therein, the second space being aligned with the first space to form the cavity when the second pivot body is in the first position, and the second space being misaligned with the first space when the second pivot body is in the second position.

23. A swing apparatus comprising a support stand having a plurality of frame members that are movable between an expanded use position and a collapsed storage position, a hanger arm coupled to the support stand, the hanger arm being swingable back and forth when the support stand is in the expanded use position, and a seat that is attachable to the hanger arm to swing therewith and that is detachable from the hanger arm, the seat having a foldable seat frame and a set of panels coupled to the foldable seat frame, the hanger arm includes a first portion and a coupling body coupled to the first portion, the seat has a joint that couples portions of the foldable seat frame together for pivoting movement, the joint is attachable to the coupling body of the hanger arm, and when the joint is attached to the coupling body, the joint is prevented from pivoting, thereby preventing the foldable seat frame from folding.

24. The swing apparatus of claim 23, the joint comprises a first pivot body having a first space formed therein and a second pivot body having a second space formed therein, the first pivot body is coupled to the second pivot body for pivoting movement between a first position in which the first and second spaces are aligned to define a body-receiving cavity and a second position in which the first and second spaces are misaligned, and the coupling body fits into the body-receiving cavity when the first pivot body is in the first position.

25. The swing apparatus of claim 24, wherein the joint further comprises a lock coupled to one of the first and second pivot bodies, the lock has a locking position in which the coupling body is prevented from being moved out of the body-receiving cavity, and the lock has a releasing position in which the coupling body is movable out of the body-receiving cavity.

26. The swing apparatus of claim 25, wherein the coupling body has a bottom surface and the lock includes a portion that underlies the bottom surface when the lock is in the locking position.

27. The swing apparatus of claim 24, wherein the joint is configured so that an opening into the body-receiving cavity is provided on a bottom of the joint when the first pivot body is in the first position and wherein the seat is moved downwardly so that the coupling body enters the body-receiving cavity through the opening.

28. The swing apparatus of claim 23, wherein the seat comprises a cloth sling coupled to the foldable seat frame and the cloth sling provides the set of panels.

* * * * *